United States Patent [19]

Golby et al.

[11] 4,137,958

[45] Feb. 6, 1979

[54] POLYPROPYLENE BAG FOR USE IN AN AUTOMATIC FILLING PROCESS

[75] Inventors: Jerome L. Golby; Steven Goodin, both of Portland, Oreg.

[73] Assignee: Golby Bag Company, Inc., Portland, Oreg.

[21] Appl. No.: 741,900

[22] Filed: Nov. 15, 1976

[51] Int. Cl.[2] ..... B65D 27/32

[52] U.S. Cl. ..... 150/1; 53/572; 53/386

[58] Field of Search ..... D9/249, 250; 150/1, 150/0.5; 53/189, 386, 389

[56] References Cited

U.S. PATENT DOCUMENTS

| | | | |
|---|---|---|---|
| D. 29,594 | 11/1898 | Arkell | D9/249 |
| D. 214,161 | 5/1969 | Anderson | D9/249 |
| D. 237,780 | 11/1975 | Behel | D9/249 |
| 2,771,010 | 11/1956 | Piazze | 150/1 |
| 3,059,390 | 10/1962 | Handzel | 53/189 |
| 3,243,099 | 3/1966 | Winegard | D9/249 |
| 3,330,093 | 7/1967 | Schorer | 53/189 |
| 3,372,857 | 3/1968 | Brayla | 150/1 |
| 3,763,627 | 10/1973 | Kupcikevicius | 53/189 |
| 3,889,449 | 6/1975 | Membrino | 53/189 |
| 3,974,625 | 8/1976 | Simmons | 53/386 |

*Primary Examiner*—Ro E. Hart

*Attorney, Agent, or Firm*—Kolisch, Hartwell, Dickinson & Stuart

[57] ABSTRACT

A polypropylene bag for use in an automatic bag filling process including a sheet of polypropylene material formed as a tube having first and second sides or expanses sealed at one transverse end and open at the other transverse end to assume an unfilled, substantially flat profile wherein spaced-apart openings or notches are arranged on the transverse open edge portion of the first expanse. In a bag filling process, horizontally stacked bags are arranged on a bag opening unit and two projecting tabs or fingers of a clamping device are inserted through the notches of the uppermost stacked bag for contact against the second or lower side. A partial vacuum producing device applies suction to the upper or first surface and pulls same upwardly. The fingers maintain the lower side substantially flat. The bag is then fully opened and positioning arms of the unit are inserted into the bag which move it into a vertical position for placement under a filling spout.

3 Claims, 5 Drawing Figures

POLYPROPYLENE BAG FOR USE IN AN AUTOMATIC FILLING PROCESS

BACKGROUND OF THE INVENTION

A. Field of the Invention

The present invention relates to bags which are used in existing automatic filling processes, and more particularly to a novel bag construction which permits the automatic filling of material such as feed or the like into a polypropylene bag.

In automatic bag filling processes, it is known to arrange a plurality of closed bags in a horizontal stack and then open a top bag by means of a suction device. The bag is then moved into a vertically open position for placement underneath a filling spout. Paper bags have been commonly used in such automatic filling processes, but the use of air pervious polypropylene bags has been heretofore impractical because a suction force applied to a bag surface will also be transmitted to the other side causing both sides to lift. The opening of a horizontally stacked polypropylene bag is thus prevented.

The present invention provides a polypropylene bag which may be used in existing automatic bag filling processes. The bag of the present invention includes spaced-apart notches which are arranged on the bag's transverse open edge portion on a first side of the bag. The notches permit holding fingers of a bag clamping device to engage a transverse open edge portion on the interior surface of a bottom or second side of the bag when a suction force is applied to the first side. The bag is opened when the suction force is moved upwardly and the opened bag may then be moved to a vertical position for filling under a spout.

B. Description of the Prior Art

Automatic filling of paper bags is known, and typically takes the form of placing a stack of substantially flat paper bags onto a bag opening machine or magazine. Paper bags used in known automatic processes have gusseted edges and a single notch located on the open transverse edge of the bag's top side. When the paper bags are placed onto the machine in a horizontal position, a bag clamping device consisting of a pivotal holding bar having a finger is placed adjacent to the upper transverse edge. The finger is inserted through the notch for contact against the lower transverse edge of the bag's bottom side. When a suction force is applied to the top side, it is raised and the bottom surface remains substantially flat due to the contacting finger. The gussets, which are accordion or bellowslike in configuration, permit the top side to be raised without also raising the substantially flat configuration of the bottom side. When a predetermined spaced distance between the top and bottom surfaces has been achieved, vertical positioning arms are automatically extended interiorly of the bag for lifting the bag into a vertical open position beneath a filling spout. It is important that the bottom side remain substantially flat so that the vertical positioning arms may be inserted into the bag without damaging contact to the transverse edge portions.

While paper bags have been used extensively in automatic bag opening and filling processes, such bags suffer from certain inherent deficiencies. For instance, paper bags can crack or tear in cold weather and are subject to rot. Paper bags, being air impervious do not "breath" and are hence unsuitable for storing some agricultural products such as potatoes, seed, etc., which require air in order not to spoil. Additionally, paper bags must be of heavy construction in order to hold dairy feed or the like, and even heavy paper material is not rodent proof.

Air pervious bags, such as burlap and polypropylene are strong and suitable for holding feed and various agricultural products but have been heretofore impractical for use in automatic bag opening and filling processes. For instance, burlap sacks or bags are air pervious and permit the lower surface of a horizontally positioned bag to be drawn up with an upper surface when suction is applied to the upper surface. The insertion of vertical positioning arms would thereby be prevented. Also, burlap bags are also sewn or stitched on one edge and hence cannot be adequately placed horizontally flat one on top of another in a bag opening unit.

Furthermore, it has been found economically impractical to form gusseted edges in either burlap sacks or polypropylene bags. Thus, if gusseted edges were not used, as the upper surface is lifted, the bottom surface around its edges also tends to lift with the finger holding down only a small portion of the bag in a relatively flat position. As the upper surface is raised further, it becomes apparent that the vertical positioning arms to be inserted into the bag for vertical placement underneath a spout will contact the edge of the bottom surface and be prevented from insertion into the bag.

With the oil crisis and worldwide inflation, it has also become apparent that burlap bags are rising in cost quite drastically. The main source of burlap bags for American use is India, and procuring such bags at a reasonable cost is becoming increasingly difficult. Therefore, the use of a polypropylene bag is quite desirable but the bag must be so altered to prevent the bottom surface from rising during an automatic opening operation. The present invention describes how a bag may be so constructed.

Polypropylene bags are also desirable because they are rodent resistant, not subject to rot and are air pervious. The present invention enables, for the first time, the automatic opening of a polypropylene bag without impermissible bottom edge distortion by providing multiple notches on a transverse open edge of an upper side. Heretofore, it was considered impossible to adopt polypropylene bags to automatic opening and filling process. Such bags were exclusively manually arranged in an open position underneath a filling spout.

SUMMARY OF THE INVENTION

The present invention contemplates a polypropylene bag for use in existing automatic bag filling processes in which a plurality of bags are first stacked on a bag opening machine in a substantially flat horizontal position. A transverse edge adjacent the open end of the bag is formed with plural notches spaced a predetermined distance apart so that fingers arranged on a clamping device may hold the bottom surface of the bag in a substantially flat position when a suction force is applied to the upper surface to open the bag. The fingers will prevent all but the area closest to the longitudinal edge portions of the bag from being drawn upwardly with the raised upper surface of the bag. Thus, as the bag has its upper surface raised, the bag opens up so that vertical positioning arms may be inserted into the bag for placing the bag in a vertical position underneath a filling spout.

A primary object of the present invention is to modify a polypropylene bag so that it may be used in existing automatic bag opening process, thereby eliminating manual opening of bags for placement underneath a filling spout.

Another object of the present invention is to modify a polypropylene bag for use in an automatic bag opening process so that expensive burlap and nonrecyclable paper bags are no longer required.

A further object of the present invention is to modify a polypropylene bag so that it may be used substantially with existing bag opening and filling processes which have been developed for paper bags.

A further object of the present invention is to use a polypropylene bag in an automatic bag filling process which does not require the forming of gusseted edges in the polypropylene bag. Forming such gusseted edges is an additional bag manufacturing step, which if eliminated, results in bag cost savings.

Still another object of the present invention is to provide a polypropylene bag for use in automatic bag opening and filling processes in which only minor modifications to existing bag opening and filling equipment is necessary. For instance, in a typical bag opening machine, a bag clamping device will consist of an elongated rod or bar having a movable finger or detent which passes through a notch in a bag for contact on a lower surface of the bag. The finger is then pivoted out of the way when the bag is lifted for vertical positioning underneath a filling spout. The present invention contemplates removal of this finger and placement of at least two laterally spaced fingers on the clamping bar. Such a modification is relatively inexpensive and may be readily constructed. The only other modification contemplated is perhaps a stronger suction force applied through the upper surface bag raising device.

Additional objects of the present invention reside in the specific construction of the exemplary polypropylene bag hereinafter particularly described in the specification and shown in the drawing.

BRIEF DESCRIPTION OF THE DRAWINGS

Novel features of the improved polypropylene bag for use in an automatic opening and filling process in accordance with the present invention will be more readily understood from a consideration of the following description taken together with the accompanying drawing, in which a preferred adaptation is illustrated with the various parts thereof identified by suitable reference characters in each of the views, and in which.

DETAILED DESCRIPTION OF THE INVENTION

Figure 1:
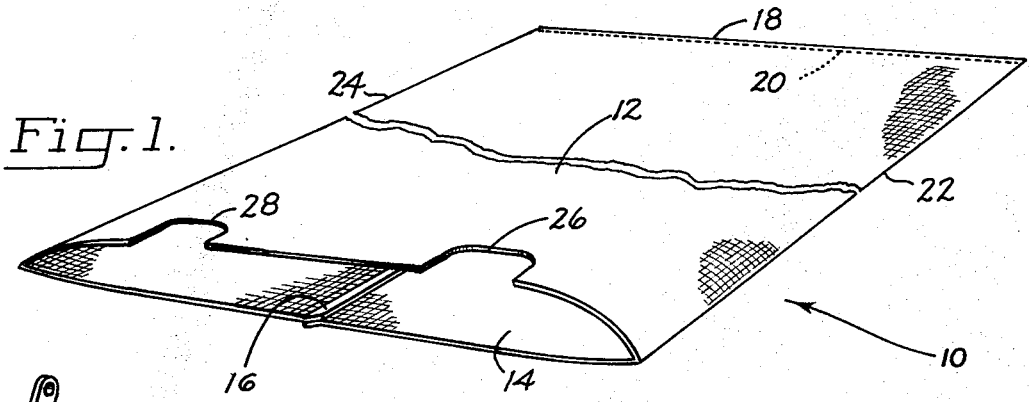
FIG. 1 is a perspective view of a polypropylene bag showing the arrangement of plural notches in accordance with the present invention.
Figure 2:
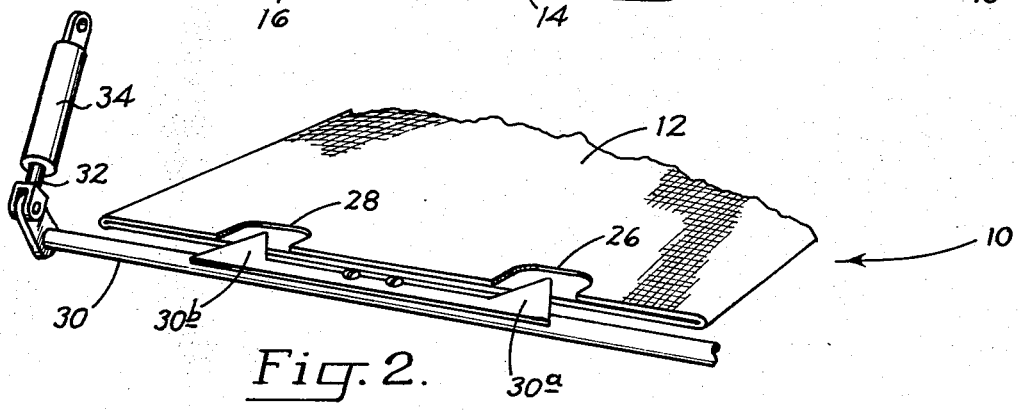
FIG. 2 is a partial view of a polypropylene bag of the present invention in which a bag clamping device having plural fingers is shown contacting the interior surface of a stacked bag preparatory to the upper surface being raised.
Figure 3:
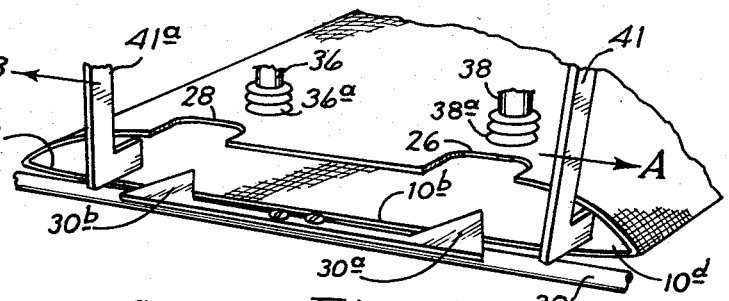
FIG. 3 is a partial view showing a suction device raising an upper surface of the polypropylene bag of the present invention illustrating how the clamping fingers maintain the lower surface horizontal when the upper surface is raised.

Features of a polypropylene bag in accordance with the principles of the present invention, generally designated at 10, may be more readily appreciated from an initial consideration of FIGS. 1–3.

Bag 10 is generally tubular and is formed from a sheet cut to a predetermined length from a roll of polypropylene material. The sheet comprising bag 10 has a first expanse or upper side 12, and a second expanse or bottom side 14 with a seam 16 running longitudinally on an underside of the bag. Seam 16 could, of course, be placed at any convenient location. Bag 10 has a transverse end 18 closed by appropriate stitching 20. Opposed longitudinally formed side folds 22 and 24 are creased in the polypropylene material to permit bag 10 to assume an unfilled, substantially flat profile.

In accordance with the present invention, bag 10 is provided with notch means formed on one side of the open edge region for receiving therethrough spaced-apart clamping fingers which contact the lower open edge region of the bag, as described below. The notch means is preferably a pair of spaced-apart notches 26, 28, formed on the bag as shown in the drawings.

A typical bag opening machine or unit includes a magazine upon which bags are horizontally stacked in a flat position. An automatic bag clamping bar having fingers is used to hold down the lower side of a bag when suction is applied to the upper side. Elongate positioning arms are then inserted into the open bag and moved against the bag's longitudinal edges for vertically positioning the opened bag beneath a filling spout. The process is continuously repeated.

Figure 4:
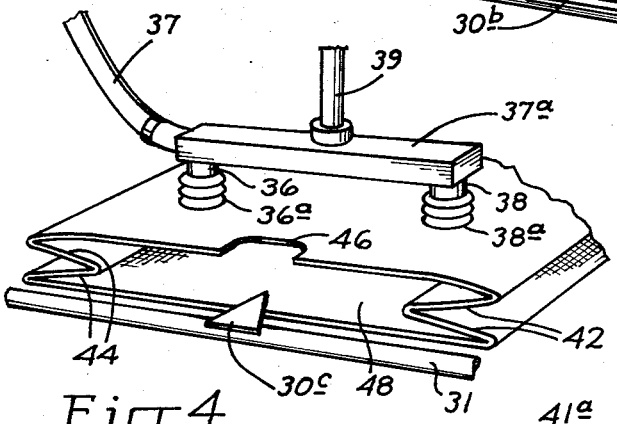
FIG. 4 shows a typical paper bag having one notch and the bag suction and clamping device used therewith.

In FIGS. 2 and 3, bag 10 of the present invention is shown directly preceding and following a bag opening operation. Initially, a plurality of bags 10 are placed in a substantially horizontal position one on top of another in a bag opening machine similar to that described above. An elongated rod holding clamp 30 is pivotally operable by means such as a pneumatically actuated arm 32 and cylinder 34. The actual frame structure which supports holding clamp 30 and a plurality of bags 10 is not shown. Clamp 30 is provided with detents or fingers **30*a* and 30*b* which are initially pivoted through notches 26 and 28 for contact against bottom side 14. Fingers 30*a* and 30*b* are illustrated as being triangular but could be made of any convenient shape. While prior art bag opening machines are known, such machines use only one finger 30*c* on a holding clamp 31, as shown in FIG. 4. FIG. 4 also illustrates in more detail a suction lifting device used in a bag opening machine. A vacuum pump (not shown) produces a suction force through hose 37 and hollow bar 37*a* leading to tubes 36, 38 and suction cups 36*a*, 38*a*. A suction device as shown in FIG. 4 is used to open bag 10 as hereinafter described. A movable rod 39 connected to bar 37*a* moves suction arms 36 and 38** downwardly for contact against an upper bag side.

Referring back to FIGS. 2 and 3, as a lifting force is applied against upper side 12 by means of suction, movable rod 39 is raised and upper side 12 is displaced upwardly. Movable rod 39 is actuated, pneumatically, for instance (not shown). As upper side 12 is raised to a predetermined height, it can be appreciated that outer portions of transverse edge portion **10*b*, to wit, edge portions 10*c* and 10*d*, bend upwardly only a small amount because fingers 30*a* and 30*b* maintain transverse edge portion 10b substantially flat or horizontal. As vertical positioning arms 41 and 41a are inserted into the interior of bag 10, they will not be obstructed by bent up lower edge portions as is the case shown in FIG. 5**.

Thus, notches 26, 28 and corresponding clamping fingers 30a, 30b are spaced apart a distance which allows a substantial portion of the lower open edge of the bag to be held flat while a side separating force is applied to the upper side of the bag. A substantial portion of the lower open edge refers to that portion of the total edge width which must be maintained flat during insertion of spaced-apart positioning arms 41 and 41a into the open bag end.

Figure 5:
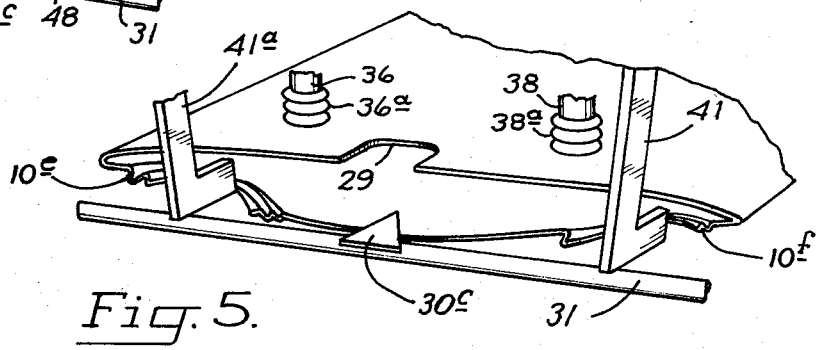
FIG. 5 is an illustration of how a polypropylene bag could not be used in an automatic process if only a single notch were formed in the upper surface.

If only a single notch 29 were used in conjunction with a single finger 30c, edge portions 10e and 10f would bend upwardly and offer an obstruction (as shown in FIG. 5) to vertical positioning arms inserted into bag 10. Vertical positioning arms 41 and 41a may also be pneumatically operated by a means (not shown) to swing downwardly inside bag 10 and then move in the direction of arrows A and B so that sufficient tension is applied along the longitudinal edges to permit arms 41 and 41a to raise bag 10 to a vertical position. Feed material or the like may then be deposited within bag 10, and the process is repeated.

FIG. 4 shows a typical paper bag 40 having gusseted edges 42 and 44. It can be appreciated that with such a structure, a single notch 46 will permit finger 30c to adequately hold down lower side 48 because gussets 42, 44 permit the raising of upper surface 40 with the assurance that lower expanse 48 will not bend upwardly. However, it is to be noted that the polypropylene material does not lend itself to being formed with gussets. The present invention enables polypropylene bags to be opened in existing machines without the necessity of providing longitudinal gusseted edges.

Thus, it can be appreciated that polypropylene bag 10 of the present invention will permit ready opening of such bags on an existing machine and subsequent vertical placement under a filling spout by arms 41 and 41a with only minor modifications to existing machines. For instance, the single finger on an existing machine's holding clamp is removed and plural fingers are secured to the clamp appropriately spaced to accommodate spaced apart flexible flaps on the polypropylene bag of the present invention.

Further, it is to be noted that existing paper bag opening processes utilize a suction force moving approximately 5–10 CFM of air. While such a low movement of air is sufficient for air impervious paper bags, applicant has determined that a modification to existing opening units is required to move air through the suction device at approximately 50–65 CFM in order to adequately hold on an upper side of an air pervious polypropylene bag to be raised. Thus, applicant has attached a larger air moving device to hose 37 to produce adequate suction for lifting of a bag's top side.

While the invention has been particularly shown and described with reference to the foregoing preferred embodiment thereof, it will be understood by those skilled in the art that other changes in form and detail may be made therein without departing from the spirit and scope of the invention as defined in the appended claims. For instance, instead of providing cut away notches as shown in the drawings, bag 10 could be provided with flaps on side 12 adjacent to edge 10a.

Fingers 30a and 30b would be permitted to move by the flaps for contact against bottom side 14 when a suction and lifting force is applied to side 12. Such flaps could be formed by cutting slots from edge 10a a predetermined distance toward closed end 18.

What is claimed is:

1. A bag for use in an automatic bag opening apparatus, said apparatus including a pair of spaced-apart clamping fingers, means for exerting a side-separating force on the bag, and a pair of spreadable positioning arms, said bag comprising;

a flexible container formed by a joined sheet of bag material defining first and second sides and a bag width, a closed end and an open end, said sides having opposed nongusseted longitudinal edges extending from said open end to said closed end for permitting said flexible container to assume an unfilled substantially flat profile; and notch means formed on said first side adjacent to said open end for receiving therethrough the spaced-apart clamping fingers so that said fingers may clamp said second side adjacent said open end for holding a substantial portion of said second side adjacent said open end substantially flat when said bag is positioned horizontally, thereby permitting a side-separating force to be applied to said first side to allow the positioning to be inserted into the bag through said open end.

2. A bag as defined in claim 1 wherein said bag material is polypropylene.

3. A bag as defined in claim 1 wherein said notch means includes a pair of spaced-apart notches.

* * * * *